US006052932A

United States Patent [19]

Reddig et al.

[11] Patent Number: 6,052,932

[45] Date of Patent: Apr. 25, 2000

[54] PRESENTATION UNIT EXTENDIBLE SIDE PANELS

[75] Inventors: Ralph Reddig, Grand Rapids; Clarkson S. Thorp, Wayland, both of Mich.

[73] Assignee: Haworth, Inc., Holland, Mich.

[21] Appl. No.: 09/092,112

[22] Filed: Jun. 5, 1998

[51] Int. Cl.[7] ..... G09F 7/08; G09F 3/20

[52] U.S. Cl. ..... 40/611; 40/657; 40/649; 40/738; 312/287

[58] Field of Search ..... 40/611, 657, 738, 40/765, 766, 729, 649; 312/306, 287

[56] References Cited

U.S. PATENT DOCUMENTS

| | | | |
|---|---|---|---|
| 1,887,523 | 11/1932 | Schenkel | 40/577 |
| 2,660,506 | 11/1953 | Wright | 312/306 |
| 3,659,365 | 5/1972 | Eaton | 40/611 X |
| 4,011,672 | 3/1977 | Grusin | 40/738 X |
| 4,196,535 | 4/1980 | Heimo | 40/738 |
| 5,105,567 | 4/1992 | Real | 40/765 |
| 5,468,063 | 11/1995 | Simonek | 312/287 X |
| 5,544,436 | 8/1996 | Lafkowitz | 40/611 X |
| 5,584,547 | 12/1996 | Trulaske, Sr. | 40/575 X |
| 5,803,560 | 9/1998 | Trulaske, Sr. et al. | 40/575 X |
| 5,903,992 | 5/1999 | Eisenberg | 40/738 |

FOREIGN PATENT DOCUMENTS

| | | | |
|---|---|---|---|
| 561969 | 2/1923 | France | 40/577 |

*Primary Examiner*—Terry Lee Melius
*Assistant Examiner*—Rodrigo J. Morales
*Attorney, Agent, or Firm*—Flynn, Thiel, Boutell & Tanis, P.C.

[57] ABSTRACT

A presentation unit which includes a frontwardly facing, substantially transparent side wall with multiple surfaces adapted for the display of information thereon, and two pull out display panels storable within the interior of the unit and extendible outwardly therefrom, which display panels are usable for displaying information. Additional display panels are provided within the interior of the presentation unit adjacent the transparent side wall and are viewable therethrough. These display panels are readily removable from the unit and thus information can be placed thereon prior to the presentation.

24 Claims, 10 Drawing Sheets

PRESENTATION UNIT EXTENDIBLE SIDE PANELS

FIELD OF THE INVENTION

This invention relates to a presentation unit and, more particularly, to an upright presentation unit having a frontwardly facing side wall and multiple removable and extendible display panels, all of which are equipped for providing visual displays.

BACKGROUND OF THE INVENTION

Various types of devices are utilized in office and teaching environments for visually displaying different types of information to groups of people. Examples of such devices are chalkboards, overhead projectors, and writable marker board arrangements. However, these conventional devices are typically not adapted to enable the user to readily move displayed information to other convenient viewable locations so that new information can be displayed and viewed contemporaneously therewith. In addition, the flat viewing surface provided by these conventional devices may not be easily viewable to all members of the audience.

SUMMARY OF THE INVENTION

It is an object of the invention, therefore, to provide a presentation unit which overcomes the above disadvantages of conventional group-display devices. More specifically, the presentation unit in accordance with the invention is generally arcuate in shape and includes a substantially transparent front side wall with multiple surfaces adapted for the display of information thereon. In addition, two enlarged pull-out extension panels are nested within the interior of the unit and are extendible outwardly therefrom. These extension panels also include surfaces adapted for displaying information thereon. Further, display panels of a smaller size are provided within the interior of the presentation unit adjacent the transparent front side wall and are viewable therethrough. The display panels are readily removable from the presentation unit and thus information can be placed thereon prior to the presentation. That is, the display panels can be pre-loaded with information during preparation for the presentation, which information is viewable by the audience at the start of the presentation.

Other objects and purposes of the invention will be apparent to persons familiar with arrangements of this general type upon reading the following specification and inspecting the accompanying drawings.

Figure 1:
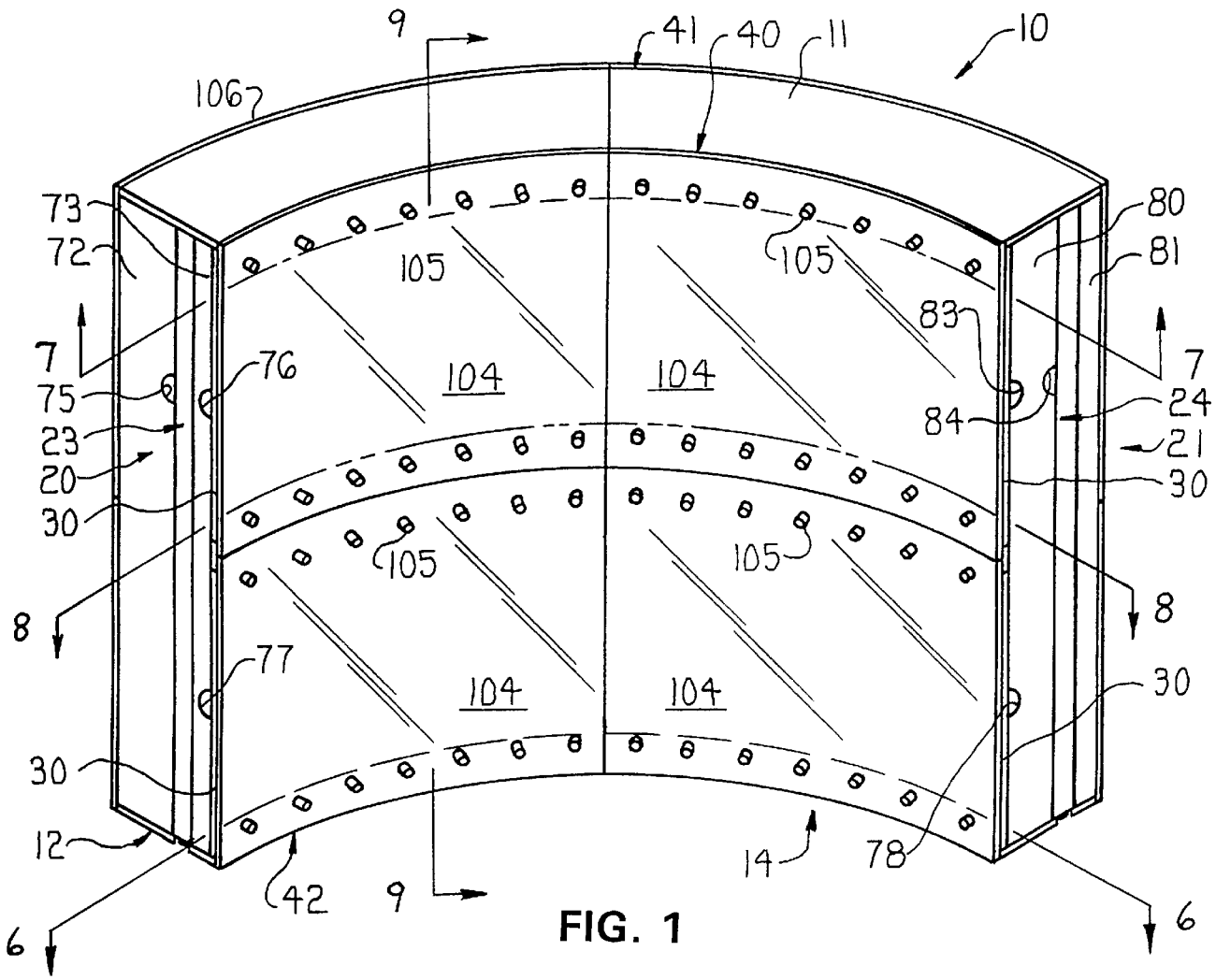
FIG. 1 is a perspective view of the presentation unit according to the present invention.

Certain terminology will be used in the following description for convenience in reference only, and will not be limiting. For example, the words "upwardly", and "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1–4 and 9, there is illustrated an upright presentation unit 10 according to a preferred embodiment of the present invention. The presentation unit 10 includes a rigid frame having spaced-apart and generally horizontally oriented top and bottom walls 11 and 12, and a generally horizontally oriented intermediate support wall 13 disposed therebetween. The frame of unit 10 may be a one-piece structure or may, as shown herein, include frame halves for convenience in assembly. Frontwardly and rearwardly facing side walls 14 and 15 are mounted on the frame and respectively define the front and rear of the unit 10, which front and rear side walls 14 and 15 are spaced-apart from one another by the top and bottom walls 11 and 12 and intermediate support wall 13.

A pair of generally vertically oriented end walls 20 and 21 are mounted on the frame and together with the top and bottom walls 11 and 12, front and rear side walls 14 and 15 define a hollow interior of unit 10. A generally vertically extending intermediate support wall 22 (FIGS. 6–8) also forms part of the frame and is preferably centrally located between end walls 20 and 21.

The frame of unit 10 is preferably constructed of a rigid material, such as wood. Other materials may also be utilized in accordance with the invention.

The unit 10 preferably includes two slidably movable extension panels 23 and 24 each respectively disposed in separate pockets or channels 25 and 26 defined in the interior of the unit 10. Extension panel 23 is extendible from the interior through end wall 20, and extension panel 24 is extendible from the interior through end wall 21. Further, four display panels 30 are slidably and removably located in upper and lower pockets or channels 34 and 35 defined in the interior of the unit 10 behind front side wall 14.

Front and rear edges 40 and 41 of the top wall 11, and front and rear edges 42 and 43 of the bottom wall 12, have a curved configuration and have radii generated about a common axis such that the unit 10 has a generally arcuate shape including arcuate front and rear side walls 14 and 15. Front side wall 14 preferably defines the working side of the unit 10.

Figure 6:
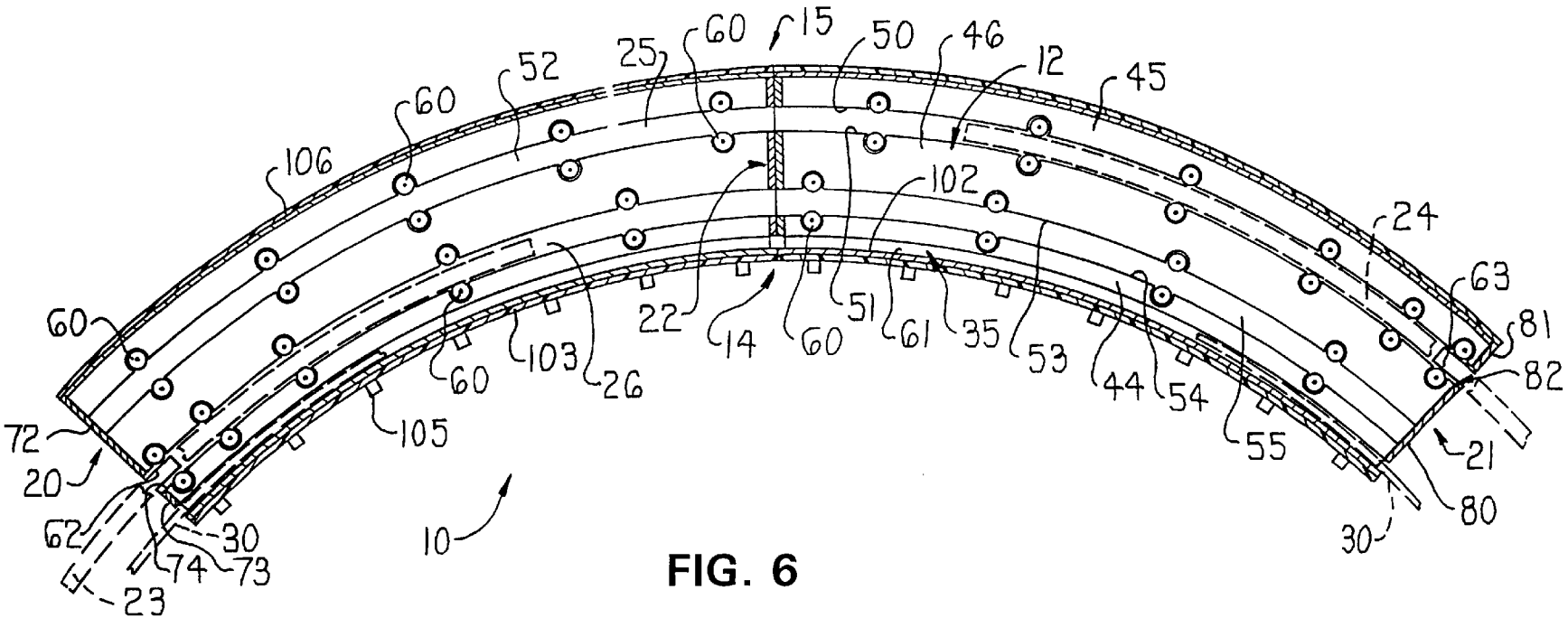
FIG. 6 is a cross-sectional view thereof taken substantially along line 6—6 in FIG. 1.
Figure 9:
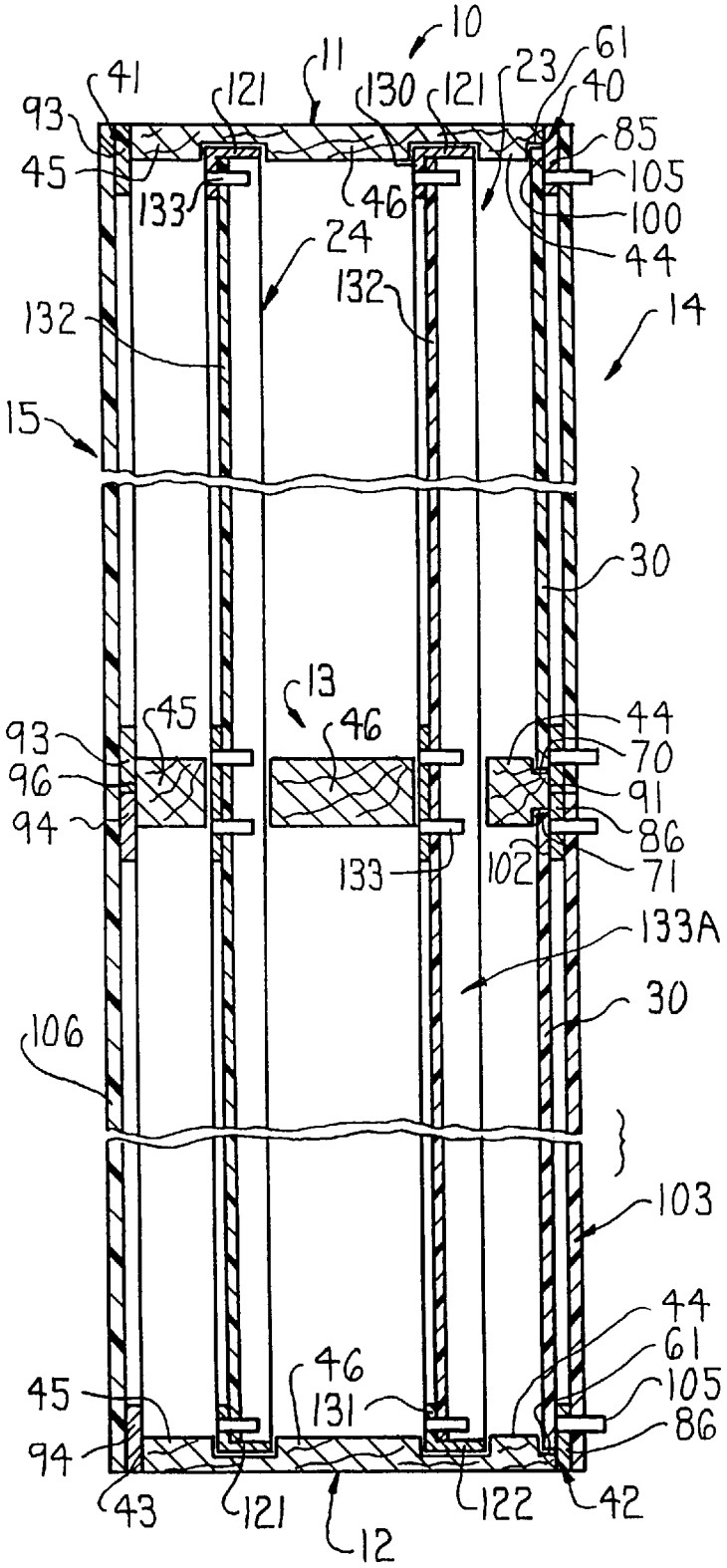
FIG. 9 is a fragmentary cross-sectional view thereof taken substantially along line 9—9 in FIG. 1.

With reference to FIGS. 6 and 9, the upwardly facing side of bottom wall 12 preferably includes front and rear elongate rail members 44 and 45, and a central elongate rail member 46 disposed therebetween. A frontwardly facing side 50 of rear rail member 45, a rearwardly facing side 51 of central rail member 46 and an upwardly facing surface 52 of bottom wall 12 together define the lowermost portion of pocket 25. Similarly, a frontwardly facing side 53 of central rail member 46, a rearwardly facing side 54 of front rail member 44 and an additional upwardly facing surface 55 of bottom wall 12 together define the lowermost portion of pocket 26. As shown in FIG. 6, a plurality of rollers 60 are disposed along each of the sides of the rear rail member 45, central rail member 46 and front rail member 44 and project slightly outwardly therefrom. The rollers 60 roll against the extension panels 23 and 24 during movement into and out of the interior of the unit 10 so as to provide smooth, gliding movement of the panels 23 and 24.

Bottom wall 12 preferably includes an elongate shoulder 61 (FIGS. 6 and 9) adjacent front rail member 44 extending along the length thereof which defines part of lower pocket or channel 35 discussed further below.

Bottom wall 12 also includes a pair of slots 62 and 63 located at opposite ends thereof which extend completely through the bottom wall 12 and respectively open through end walls 20 and 21.

Figure 7:
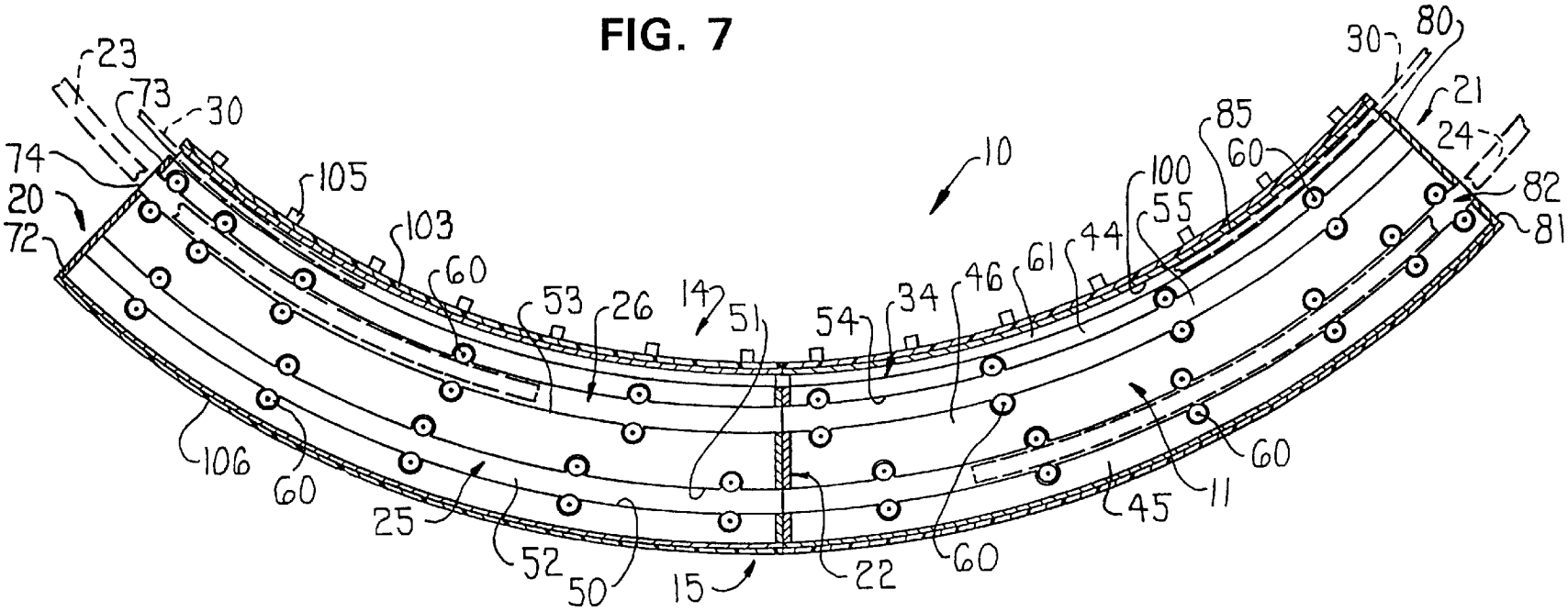
FIG. 7 is a cross-sectional view thereof taken substantially along line 7—7 in FIG. 1.

The downwardly facing side of the top wall 11 is shown in FIG. 7, which top wall 11 is a mirror image of bottom wall 12, except that top wall 11 preferably does not include slots 62 and 63 therein. Therefore, the same reference numbers are used in FIG. 7 to depict the same or similar parts as shown in FIG. 6.

Figure 8:
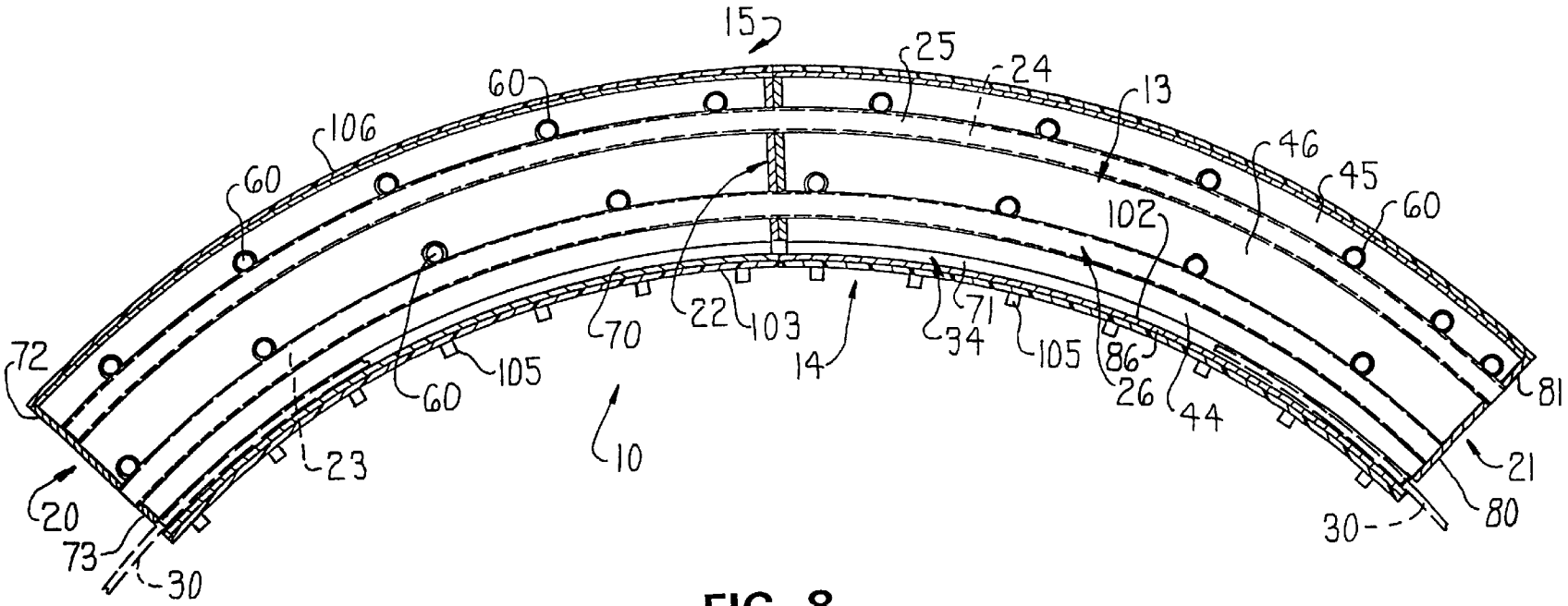
FIG. 8 is a cross-sectional view thereof taken substantially along line 8—8 in FIG. 1.

With reference to FIG. 8, intermediate support wall 13, similarly to top and bottom walls 11 and 12, also includes front and rear rail members 44 and 45, with central rail member 46 being disposed therebetween. Further, intermediate support wall 13 preferably includes rollers 60 disposed along the frontwardly facing side of rear rail member 45 and the frontwardly facing side of central rail member 46 to enable the extension panels 23 and 24 to move easily within pockets 25 and 26, particularly when same are moved from an extended position (FIG. 2) to a retracted position (FIG. 1).

As best shown in FIG. 9, front rail member 44 of intermediate support wall 13 has two oppositely facing elongate shoulders 70 and 71, both of which extend along the length of front rail member 44 and respectively define parts of upper and lower pockets 34 and 35.

With reference to FIGS. 1 and 6, end wall 20 includes two vertically extending panel sections 72 and 73 disposed spaced-apart from one another so as to define a generally vertically extending gap 74 therebetween, which gap 74 is aligned with, and forms part of front pocket 26. As discussed above, slot 62 of bottom wall 12 opens through gap 74. Each of panel sections 72 and 73 preferably include frontwardly opening, semi-circular recesses 75 and 76 at upper portions thereof, and panel section 73 also includes a frontwardly opening recess 77 at a lower portion thereof.

End wall 21 also includes two longitudinally extending panel sections 80 and 81 spaced-apart from one another so as to define a generally vertically oriented gap 82 (FIG. 6) therebetween. Gap 82 preferably is aligned with and forms part of rear pocket 25, and slot 63 of bottom wall 12 opens through gap 82. Panel section 80 has frontwardly and rearwardly opening, semi-circular recesses 83 and 84 at an upper portion thereof, and a frontwardly opening, semi-circular recess 78 at a lower portion thereof.

The frame of presentation unit 10 further includes a pair of rectangular upper and lower frame members 85 and 86 (FIG. 9) oriented at the front of the unit 10. Upper frame member 85 is fixedly attached, for example by screws, to frontwardly facing edge surface 40 of top wall 11 and a frontwardly facing edge surface 91 of front rail member 44 of intermediate support wall 13. Lower frame member 86 is fixedly attached to frontwardly facing edge surface 91 of intermediate support wall 13 and to frontwardly facing edge surface 42 of bottom wall 12.

An additional pair of rectangular upper and lower frame members 93 and 94 also form part of the frame and are oriented at the rear of the unit 10. Upper frame member 93 is fixedly attached to rearwardly facing edge surface 41 of top wall 11 and a rearwardly facing surface 96 of rear rail member 45 of intermediate support wall 13. Lower frame member 94 is fixedly attached to rearwardly facing edge surface 96 of intermediate support wall 13 and to rearwardly facing edge surface 43 of bottom wall 12.

An inwardly facing surface 100 of upper front frame member 85 serves to define the topmost part of upper pocket 34 along with shoulder 61 of top wall 11, and also serves to define the lowermost part of upper pocket 34 along with shoulder 70 of front rail member 44 of intermediate support wall 13.

Likewise, an inwardly facing surface 102 of the lower front frame member 86 defines the uppermost part of lower pocket 35 along with shoulder 71 of front rail member 44 of intermediate support wall 13, and also defines the lowermost part of lower pocket 35 along with shoulder 61 of bottom wall 12.

Upper and lower pockets 34 and 35 each open sidewardly at one end of the unit 10 adjacent the front edge of panel section 73 of end wall 20, and at the other end of the unit 10 adjacent the front edge of panel section 80 of end wall 21. The frame members 85, 86, 93 and 94 are preferably constructed of lightweight metal, such as aluminum and preferably provide rigidity and stability to the frame of unit 10.

The front side wall 14 is embodied by a sheet-like panel 103 which extends across the entire front of the unit 10 and is fixedly attached to frontwardly facing edge surfaces 40 and 42 of top and bottom walls 11 and 12, respectively, for example by screws which extend through upper and lower frame members 85 and 86. Panel 103 may be a one-piece panel or may include multiple (here four) rectangular panels 104 as shown in FIG. 1. Panel 103 preferably is constructed of a smooth and rigid material capable of being written upon by ink markers of the erasable type, and a material which permits visibility therethrough. Various polymeric materials would satisfy these requirements, one example of which is polypropylene.

With reference to FIG. 1, a plurality of outwardly extending pegs 105 are disposed in horizontal rows across the upper and lower edges of each of the panels 104 in a generally evenly spaced-apart manner with respect to one another.

The rear side wall 15 is also embodied by a sheet-like panel 106 which extends across the entire rear of the unit 10 and is fixedly attached to rearwardly facing edge surfaces 41 and 43 of top and bottom walls 11 and 12, respectively, for example by screws which extend through upper and lower frame members 93 and 94. Panel 106 may be a one-piece panel or may include multiple panels. Panel 106 is preferably constructed of the same or similar material as front panel 103.

Figure 3:
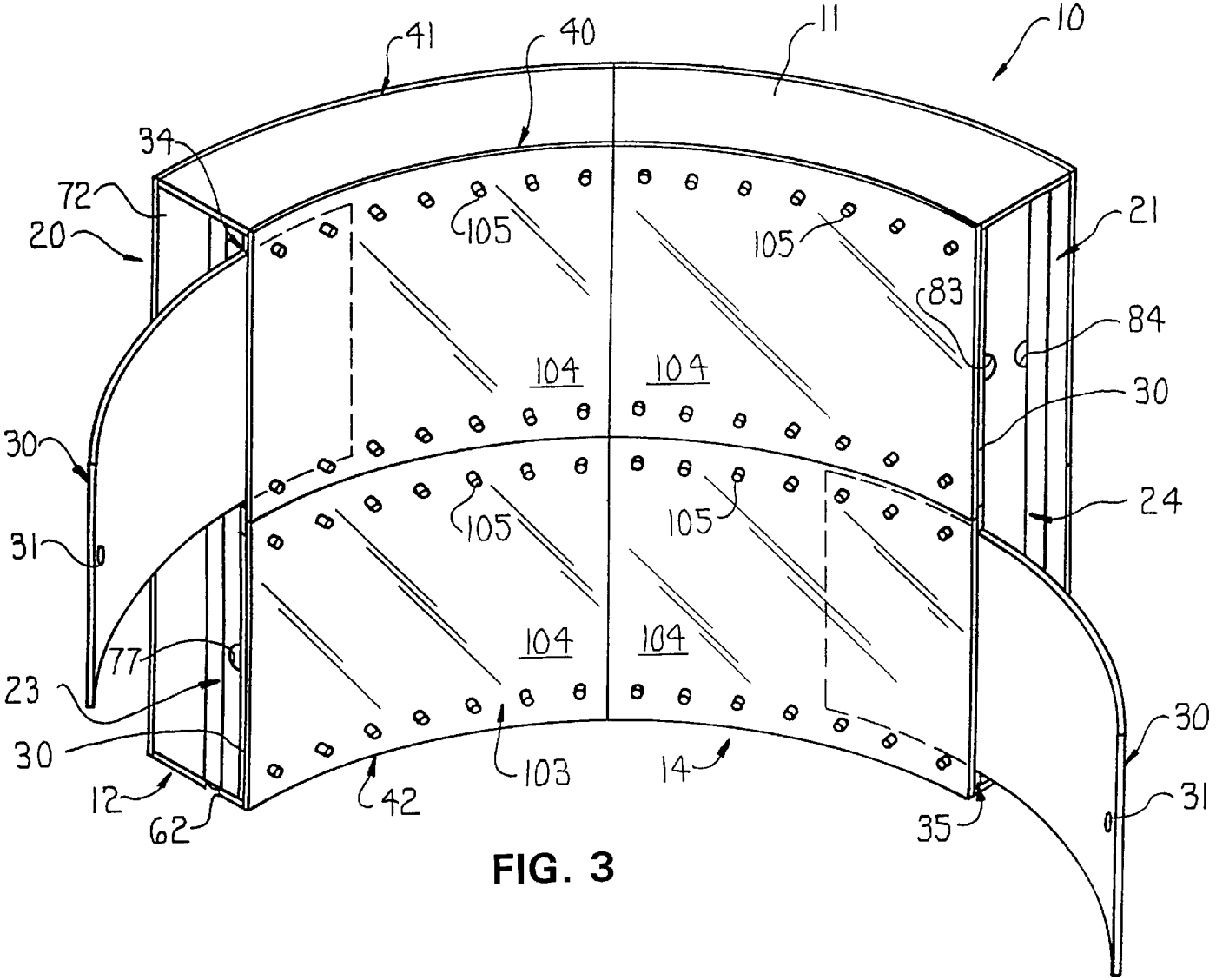
FIG. 3 is a perspective view thereof similar to FIG. 1 but showing various ones of the display panels in partially extended positions.

As illustrated in FIG. 3, display panels 30 are slidably and removably disposed in upper and lower pockets 34 and 35. That is, two upper display panels 30 are disposed side by side within upper pocket 34, and two lower display panels 30 are disposed side by side in lower pocket 35. Each display panel 30 includes a finger grip or hole 31 extending therethrough adjacent an outermost frontwardly facing edge thereof. The display panels 30 are constructed of a smooth and rigid sheet-like material capable of being written upon by ink markers of the erasable type, for example a polymeric material such as polypropylene.

Figure 5:
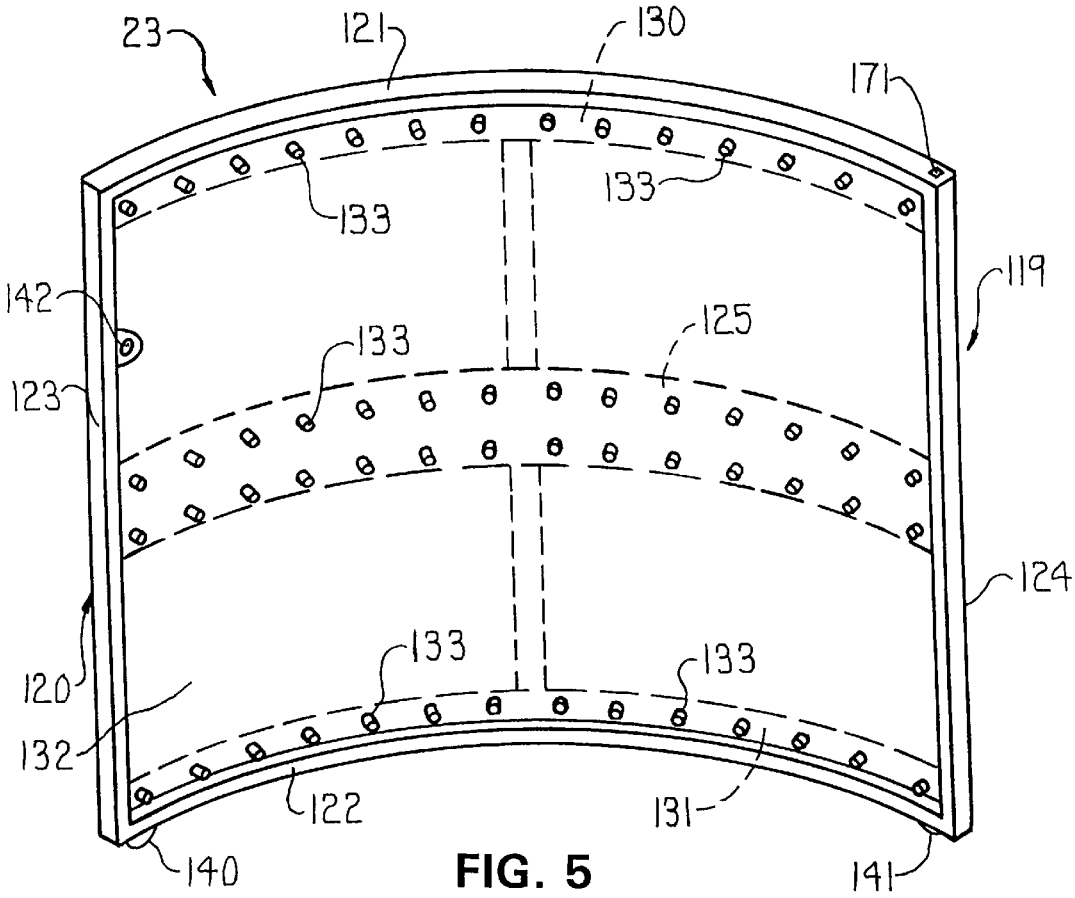
FIG. 5 is a perspective view of an extension panel thereof.

Turning now to extension panels 23 and 24, extension panels 23 and 24 are substantially identical to one another, except that rear extension panel 24 has a somewhat greater width as compared to front extension panel 23. Only front extension panel 23 is shown in FIG. 5 and will be described here for purposes of simplicity. The same reference numbers are used to depict the same or similar parts of extension panels 23 and 24. Extension panel 23 preferably includes an arcuate frame 119 including a generally rectangular outer frame member 120 which defines the periphery of extension panel 23. Outer frame member 120 includes top and bottom walls 121 and 122 having generally L-shaped cross-sections (FIG. 9), and a pair of side walls 123 and 124 which interconnect and extend between top and bottom walls 121 and 122. Frame 119 also includes an elongate intermediate frame member 125 which extends generally horizontally between and interconnects side walls 123 and 124.

Intermediate frame member 125 and downwardly and upwardly extending portions 130 and 131 of top and bottom walls 121 and 122, respectively, are all offset rearwardly and are vertically aligned with one another. A sheet-like panel 132 is preferably fixedly fastened to frontwardly facing sides of portions 130, 131 and intermediate frame member 125 so as to define a shallow, frontwardly opening recess 133A (FIG. 9) in extension panel 23. Panel 132 may be a single panel or multiple panels, and is preferably constructed of a rigid, smooth material capable of being written on with ink markers of the erasable type, such as a polymeric material. One example of such a material is polypropylene, however, other materials may be utilized in accordance with the invention.

As shown in FIG. 5, a plurality of outwardly extending pegs 133 are disposed in horizontal rows across the upper and lower edges of the panel 132, and two additional horizontal rows of pegs 133 are disposed centrally between the upper and lower rows. The panel 132 preferably has a surface area similar to the total surface area of the panels 104 of front side wall 14, and the pegs 133 are arranged on the panel 132 in an identical manner as pegs 105 on front side wall 14.

Figure 10:
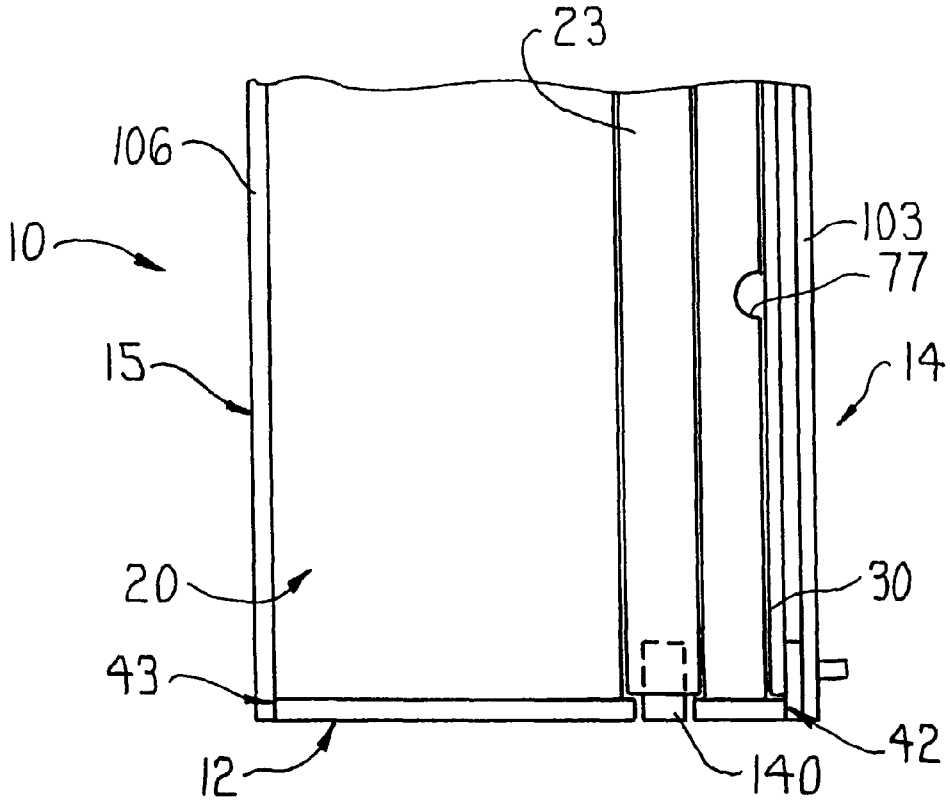
FIG. 10 is a fragmentary side view of the lower end thereof.

The extension panel 23 additionally includes a roller or wheel 140 (FIGS. 5 and 10) mounted partially within the bottom wall 122 of frame 119 at the free end of the extension panel 23 and projects into slot 62 of bottom wall 12 when the extension panel 23 is fully retracted into the interior of the unit 10. Thus, the roller 140 is at all times engaged with a floor surface, regardless of whether the extension panel 23 is in the retracted position or the extended position. An additional roller 141 is located at the opposite end of the extension panel 23 and is mounted within bottom wall 122 of frame 119 and rides along upwardly facing surface 55 of bottom wall 12 within pocket 26 when the extension panel 23 is extended from the unit 10 or retracted into the unit 10. Roller 141 is preferably mounted at a greater vertical height within bottom wall 122 of extension panel 23 than roller 140 so that the extension panel 23 is level whether located inside or outside the unit 10. Additional rollers similar to roller 141 may be provided along the bottom wall 122, if desired.

The extension panel 23 also includes a finger grip 142 located adjacent side wall 123. The finger grip 142 is located at approximately the same height as recess 75 of end panel 20 and can thus be reached by the finger of a user through recess 75 when extension panel 23 is in the fully retracted position, and can thus be utilized to extend panel 23 out of the unit 10.

Figure 2:
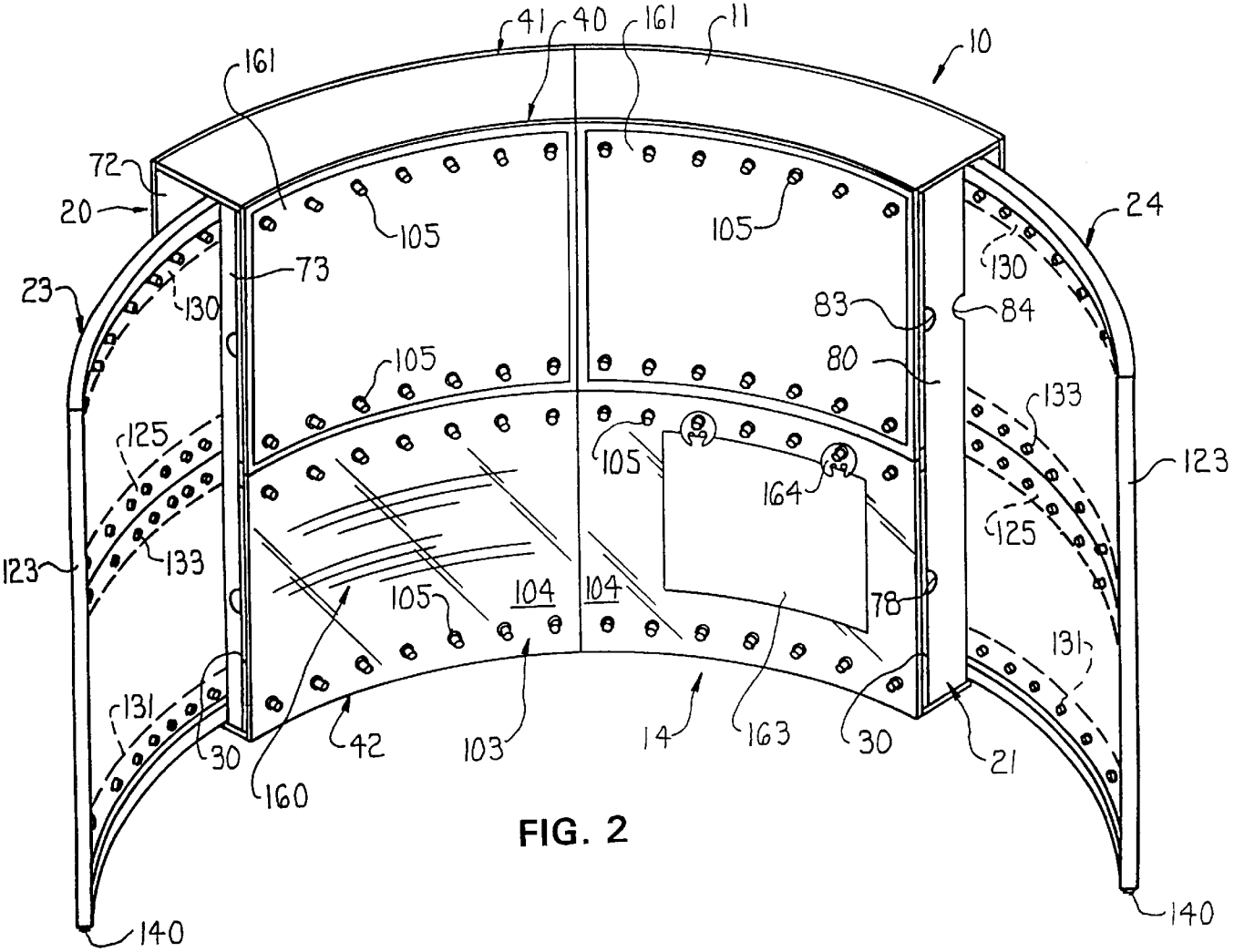
FIG. 2 is a perspective view thereof similar to FIG. 1 but showing the extension panels in a partially extended position.

With reference to FIG. 2, the presentation unit 10 is adapted to display information in various ways. For example, prior to the presentation, the user may remove one or more display panels 30 from the unit 10 by inserting a finger into the appropriate recess 76, 77, 83 or 78 of end panels 20 and 21 and engaging the finger grip 31 of the display panel 30. The user can then write the desired information 160 (FIG. 2) on the display panel 30 and insert same back into the unit 10. Since panel 103 is transparent, the information 160 located on the display panel 30 is visible through sheet 103 and is immediately available for viewing by audience members upon arrival or at the beginning of the presentation.

With continued reference to FIG. 2, the individual panels 104 of front side wall 14 may be written upon by the user during the presentation, for example, or alternatively may be covered with flexible and smooth sheets 161 of a material capable of being written upon by ink markers of the erasable type. Sheets 161 preferably include holes therein which are spaced in a substantially identical manner as pegs 105 so that the sheets 161 can be fastened thereon. The user then writes the desired information on the sheets 161, which may be hung on any of the panels 104 on front side wall 14. One example of such sheets 161 which are usable with the present invention are Poly-rite sheets. Different sizes of sheets 161 other than that shown may also be utilized.

Figure 11:
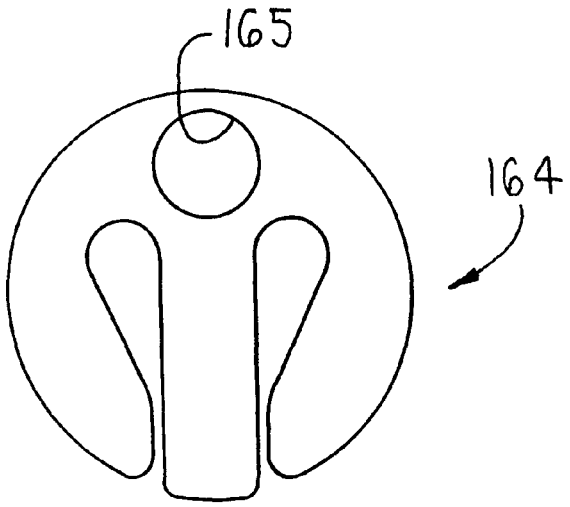
FIG. 11 is a plan view of a clip.

Further, if desired, the user may hang paper sheets or other documents 163 on panels 104 with clips 164 (FIG. 11), which preferably include a hole 165 which penetrates therethrough. The clips 164 are preferably hung on pegs 105, which pegs 105 project through the hole 165 of each clip 164, and the clips 164 thus grip the upper edge of the paper sheet 163 so that same can be written upon and displayed. In this regard, if the user chooses to write information on paper sheets 163 during the presentation, the paper sheets 163 may then be removed from the panels 104 at the end of the presentation, rolled up and taken by an audience member or members.

Figure 4:
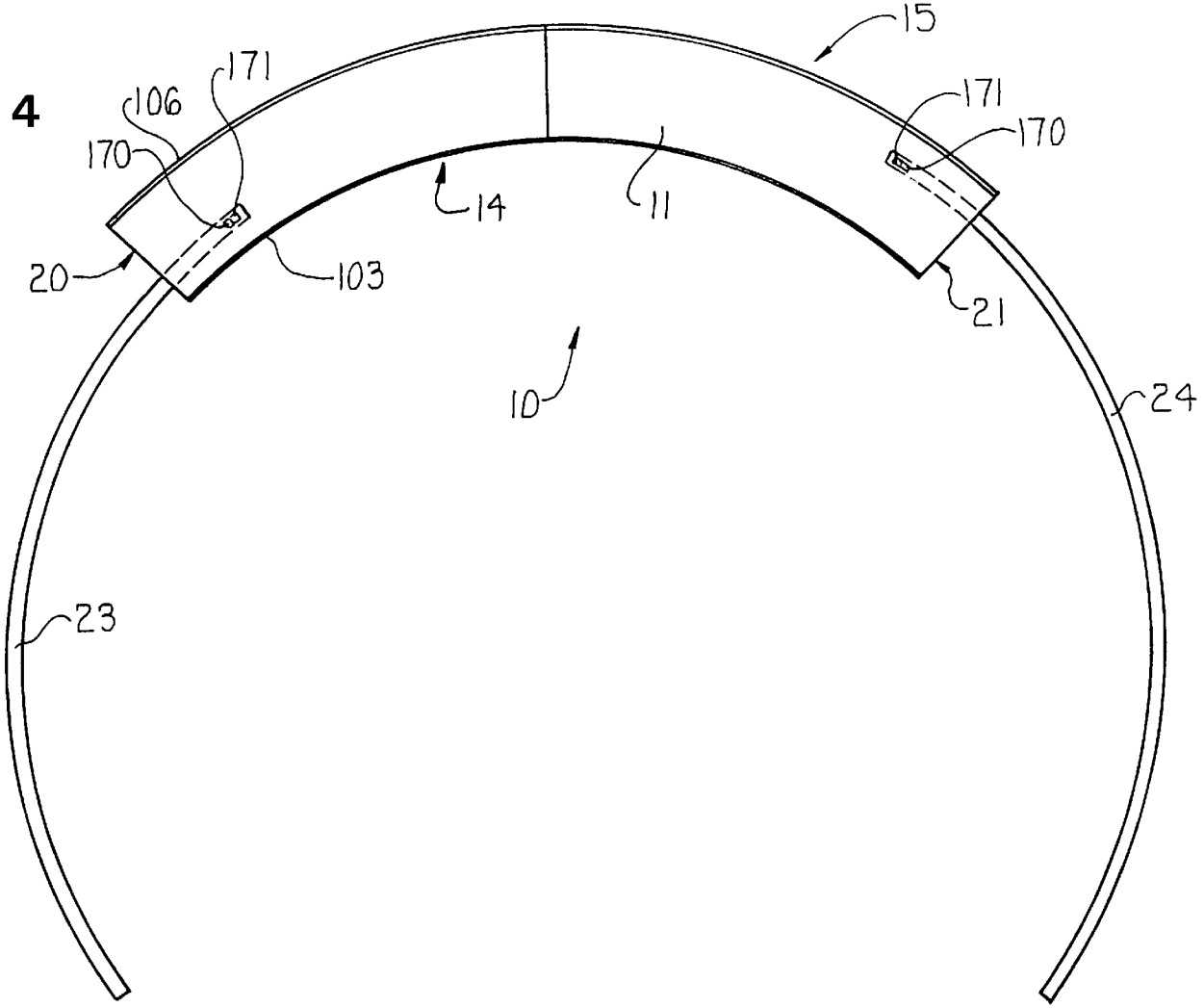
FIG. 4 is a plan view thereof showing the extension panels in fully extended positions.

Still further, if the particular presentation requires the display of a large amount of information, the extension panels 23 and 24 may be extended by inserting a finger through recess 75, 84 of side walls 20 and 21, respectively, and into finger grips 123 of extension panels 23 and 24 and pulling outwardly. Since the extension panels 23 and 24 are configured similarly to panel 103 of front side wall 14, sheets 161 or 163 may be fastened on pegs 133 of either extension panel 23 or extension panel 24, and thus may be moved to different locations on the unit 10 convenient to the user during the presentation. Extension panels 23 and 24 may be pulled out to the positions shown in FIG. 4 if a large volume of information must be displayed, or may be pulled only partially out of the unit 10. In this regard, a portion of each extension panel 23 and 24 preferably remains within the unit 10 as shown in FIG. 4 in the fully extended positions of the panels 23 and 24, and the panels 23 and 24 are preferably prevented from being removed completely from the unit 10 by stops 170 (FIG. 4) which extend a slight distance downwardly from top wall 11 and within pockets 25 and 26 which engage with correspondingly located upwardly projecting stops 171 of extension panels 23 and 24 (FIGS. 4 and 5).

The unit 10 according to the invention preferably has a height ranging from about 5–9 feet, and preferably 7 feet, and extends through an angle in the neighborhood of about 80° to 100°, and preferably 90°. The depth of the unit 10 is in the neighborhood of about 8 to 15 inches, and preferably 12 inches, and the unit 10 preferably has a width from end to end in the neighborhood of about 10 to 15 feet, and preferably 12 feet.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A presentation unit comprising:

a housing having a hollow interior defined by a front concave side wall and a rear convex side wall substantially uniformly spaced horizontally rearwardly from said front side wall to provide said housing with an arcuate configuration and to support said unit in an upright and freestanding manner from a floor surface, said front side wall defining thereon an outer surface configured for displaying information thereon; and a display panel disposed between said front and rear side walls and being slidably extendible outwardly from said interior through a generally vertically oriented end of said housing, said display panel including a roller mounted on a bottom portion thereof in direct engagement with the floor surface when said display panel is in an extended position outside of said interior, and said display panel having a height dimension and an arcuate configuration respectively similar to a height dimension and said arcuate configuration of said housing such that when said display panel is in said extended position, said housing and said display panel define a continuous and arcuate space-dividing wall.

2. The presentation unit of claim 1 wherein said end of said housing is a first end and said display panel is a first display panel, and a second display panel is disposed between said front and rear side walls and is slidably extendible outwardly from said interior through a second generally vertically oriented end of said housing horizontally spaced from said first end.

3. The presentation unit of claim 1 including an additional display panel slidably and removably disposed within said interior and supported solely by said housing.

4. A presentation unit comprising:

an upright frame;

a first side wall disposed on said frame;

a second side wall disposed on said frame and being spaced-apart from said first side wall;

said frame including generally horizontal top and bottom walls and first and second generally vertical and immovable end walls extending transversely between and interconnecting said first and second side walls to define a hollow interior of said unit, said frame defining first and second pockets within said interior;

a first display panel slidably disposed in said first pocket between said first and second side walls and being extendible outwardly from said interior through said first end wall; and a second display panel slidably disposed in said second socket between said first and second side walls and being extendible outwardly from said interior through said second end wall, each said first and second display panel including a roller mounted on a bottom portion thereof in direct engagement with a floor surface such that said first and second display panels, when in an extended position outside of said interior, are positioned on the floor surface and project upwardly therefrom.

5. The presentation unit of claim 4 wherein said first and second end walls each define therein a vertically elongate slot through which the respective first and second display panels are extendible.

6. The presentation unit of claim 4 wherein said first and second end walls extend transversely between said top and bottom walls and said first and second side walls so as to enclose said interior, each said first and second end wall defining therein a generally vertically oriented elongate slot which communicates with said interior and through which the respective first and second display panels are extendible.

7. The presentation unit of claim 4 wherein said second pocket is spaced horizontally rearwardly from said first pocket.

8. The presentation unit of claim 4 wherein said first side wall includes a plurality of pegs extending generally horizontally and outwardly therefrom for supporting a flexible sheet of material capable of being written upon.

9. The presentation unit of claim 8 wherein said first and second display panels each include a plurality of pegs extending outwardly therefrom for supporting a flexible sheet of material capable of being written upon, said plurality of pegs of said first and second display panels being arranged on said panels in a similar manner as said plurality of pegs of said first side wall.

10. The presentation unit of claim 4 wherein said first side wall is constructed of a material capable of being written upon by ink markers of the erasable type.

11. The presentation unit of claim 4 wherein said first side wall is disposed on a front portion of said frame and defines thereon a forwardly facing surface configured for displaying information thereon, and said second side wall is disposed on rear portion of said frame horizontally rearwardly of said first side wall, said first side wall includes a portion of a material which permits visibility therethrough, said frame defines an additional interior pocket between said first side wall and said first pocket and an additional display panel is slidably and removably disposed within said additional pocket, said additional display panel being constructed of a material capable of being written upon by erasable ink markers and being disposed to lie closely adjacent an interior surface of said first side wall portion opposite said forwardly facing surface such that information displayed on said additional display panel is visible through said forwardly facing surface and said first side wall portion.

12. The presentation unit of claim 4 wherein said first side wall is constructed of a continuous and unbroken sheet-like panel which defines thereon a forwardly facing surface, said forwardly facing surface being generally vertically oriented for displaying information thereon.

13. The presentation unit of claim 4 wherein said first and second side walls each have a curved configuration defined by radii generated substantially about a common generally vertical axis to provide said unit with an arcuate configuration.

14. The presentation unit of claim 4 wherein said top wall defines therein first and second downwardly opening guide channels and said bottom wall defines therein first and second upwardly opening guide channels respectively vertically aligned with said first and second top wall guide channels, said first guide channels of said top and bottom walls defining at least part of said first pocket and said second guide channels of said top and bottom walls defining at least part of said second pocket.

15. The presentation unit of claim 14 wherein said frame further includes an intermediate wall disposed between and generally parallel to said top and bottom walls, said intermediate wall having a first guide channel extending therethrough and being vertically aligned with said first guide channel of each said top and bottom wall, and a second guide channel extending through said intermediate wall and being vertically aligned with said second guide channel of each said top and bottom wall, said top, bottom and intermediate walls each including rollers mounted therealong adjacent the respective said first and second guide channels for rolling engagement with said first and second display panels to provide smooth gliding movement thereof into and out of said interior.

16. The presentation unit of claim 4 wherein said unit further includes stop means cooperating between said frame and said first and second display panels for limiting extension of each said first and second display panel from said interior.

17. The presentation unit of claim 4 wherein said rollers are first rollers, said first and second display panel each include a second roller mounted along said bottom portion thereof and spaced from said first rollers, said second rollers being disposed for rolling engagement with an upwardly facing interior surface of said bottom wall, and said first rollers being disposed for directly engaging a floor surface such that said first and second display panels when in an extended position project in an upright manner from the floor surface.

18. A presentation unit comprising:

an upright frame;

a first side wall disposed on said frame and defining thereon an outer surface configured for displaying information thereon, a portion of said first side wall being of a material which permits visibility through said outer surface;

a second side wall disposed on said frame and being spaced-apart from said first side wall to define a hollow interior of said unit;

a first display panel slidably disposed between said first and second side walls and being extendible outwardly from said interior, said first display panel including a floor engaging structure mounted along a bottom portion thereof which directly engages a floor surface when said first display panel is in either a stored position within said interior or an extended position outside said interior, said first display panel being adapted for displaying information thereon; and a second display panel slidably and removably disposed within said interior between said first side wall and said first display panel and being adapted for displaying information thereon, said second display panel being disposed so as to lie closely adjacent an interior surface of said first side wall portion opposite said outer surface such that information displayed on said second display panel is visible through said outer surface and said first side wall portion.

19. The presentation unit of claim 18 wherein said first and second side walls have a curved configuration defined by radii generated substantially about a common generally vertical axis to provide said unit with a generally arcuate shape.

20. The presentation unit of claim 18 including:

a third display panel slidably disposed within said interior between said first display panel and said second side wall, said third display panel being adapted for displaying information thereon, said third display panel being extendible outwardly from said interior and including a floor engaging structure mounted along a bottom portion thereof which directly engages a floor surface when in either a stored position within said interior or an extended position outside said interior, said first and third display panels, when in said extended position, function as upright space-dividing panels.

21. The presentation unit of claim 20 wherein said frame includes generally horizontally disposed top and bottom walls and generally vertically disposed first and second end walls extending transversely between and interconnecting said first and second side walls, said top and bottom walls, said first and second end walls and said first and second side walls together defining said interior, each said first and second end wall including a generally vertically extending opening therein, said opening of said first end wall being configured for permitting said first display panel to extend therethrough and out of said interior, and said opening of said second end wall being configured for permitting said third display panel to extend therethrough and out of said interior.

22. The presentation unit of claim 18 wherein substantially the entire extent of said first side wall is of a material which permits visibility therethrough, and additional panels similar in configuration to said second display panel are slidably and removably disposed within said interior between said first and second side walls in a vertically stacked, end-to-end arrangement, said additional panels lying closely adjacent said interior surface of said first side wall and being adapted for displaying information thereon.

23. The presentation device of claim 22 wherein said material of said first side wall is a polymeric material.

24. The presentation unit of claim 18 where in said frame includes a pair of generally horizontally oriented top and bottom walls extending transversely between and interconnecting said first and second side walls and said first display panel includes a pair of rollers mounted along said bottom portion thereof, a first of said rollers being disposed for rolling engagement with an upwardly facing interior surface of said bottom wall and said floor engaging structure including a second of said rollers which can directly engage the floor surface.

* * * * *

UNITED STATES PATENT AND TRADEMARK OFFICE
CERTIFICATE OF CORRECTION

PATENT NO : 6 052 932
DATED : April 25, 2000
INVENTOR(S) : Ralph REDDIG, et al.

It is certified that error appears in the above-identified patent and that said Letters Patent are hereby corrected as shown below:

Column 7; line 63, change "socket" to ---pocket---.

Column 8; line 36, after "on" insert ---a---.

Signed and Sealed this

Tenth Day of April, 2001

*Attest:*

Nicholas P. Godici

NICHOLAS P. GODICI

*Attesting Officer*

*Acting Director of the United States Patent and Trademark Office*